US008668466B2

(12) United States Patent
Allen

(10) Patent No.: US 8,668,466 B2
(45) **Date of Patent: *Mar. 11, 2014**

(54) VARIABLE DISPLACEMENT RECIPROCATING PUMP

(75) Inventor: Thomas E. Allen, Tulsa, OK (US)

(73) Assignee: Serva Corporation, Wichita Falls, TX (US)

( * ) Notice: Subject to any disclaimer, the term of this patent is extended or adjusted under 35 U.S.C. 154(b) by 301 days.

This patent is subject to a terminal disclaimer.

(21) Appl. No.: 12/902,031

(22) Filed: Oct. 11, 2010

(65) Prior Publication Data

US 2011/0023701 A1 Feb. 3, 2011

Related U.S. Application Data

(63) Continuation of application No. 11/206,731, filed on Aug. 18, 2005, now Pat. No. 7,811,064.

(51) Int. Cl.
*F04B 1/07* (2006.01)

(52) U.S. Cl.
USPC ..... 417/218; 417/219; 417/221; 74/579 R; 74/579 E; 74/567; 74/569

(58) Field of Classification Search
USPC ..... 417/372, 269, 221, 270, 271, 273, 218, 417/219; 74/579 R, 579 E, 567, 569; 92/12.1, 12.2
See application file for complete search history.

(56) References Cited

U.S. PATENT DOCUMENTS

| | | | | | |
|---|---|---|---|---|---|
| 2,592,237 | A * | 4/1952 | Bradley | 74/570.21 |
| 2,834,223 | A * | 5/1958 | Strnad | 74/570.21 |
| 2,892,360 | A * | 6/1959 | Ill | 74/570.21 |
| 2,900,839 | A * | 8/1959 | MacKintosh | 74/570.2 |
| 3,074,285 | A * | 1/1963 | Hausmann | 74/15.2 |
| 3,107,549 | A * | 10/1963 | Matthews | 74/570.21 |
| 6,606,935 | B2 * | 8/2003 | Jones | 92/13.7 |
| 6,742,441 | B1 * | 6/2004 | Surjaatmadja et al. | 92/13.7 |
| 6,752,605 | B2 * | 6/2004 | Dreiman et al. | 418/5 |
| 6,997,683 | B2 * | 2/2006 | Allington et al. | 417/18 |
| 7,811,064 | B2 * | 10/2010 | Allen | 417/218 |

* cited by examiner

*Primary Examiner* — Christpher Bobish
(74) *Attorney, Agent, or Firm* — McAfee & Taft

(57) ABSTRACT

A variable displacement reciprocating pump with pumping rate that is adjustable from zero to maximum stroke while the pump is running. Stroke is varied by changing relative position of pairs of eccentric inner and outer cams that drive the pump's plungers. The pump's input drive shaft drives two gear trains: a first gear train that turns the inner cams and a second gear train that turns the outer cams. These cams normally revolve together with no relative motion occurring between them. A rotary actuator is positioned in the first gear train to rotate the inner cams relative to the outer cams and thereby changes the pump's stroke. A computerized system of sensors and control valves allows the pump to be automatically controlled or limited to any one or combination of desired output flow, pressure and horsepower.

11 Claims, 9 Drawing Sheets

VARIABLE DISPLACEMENT RECIPROCATING PUMP

CROSS REFERENCE TO RELATED APPLICATION

This application is a continuation of U.S. patent application Ser. No. 11/206,731 entitled VARIABLE DISPLACEMENT RECIPROCATING PUMP, filed Aug. 18, 2005 now U.S. Pat. No. 7,811,064.

BACKGROUND OF THE INVENTION

1. Field of the Invention

The present invention relates to a variable displacement reciprocating pump. The invention is described as a multi-plunger well service pump, but is not so limited since the invention can be used for a variety of applications and in a variety of arrangements, including single plunger pumps.

2. Description of the Related Art

Reciprocating pumps are widely used in a variety of applications. One application involves multi-plunger pumps for oil well service work. These pumps typically are high pressure pumps operating at pressures that range from low pressures to pressures as high as 15,000 psi. The pumping rate varies from low rates to more than 18 barrels per minute.

The pump prime mover, engine or electric motor, that powers the pump is normally coupled to the pump through a transmission. For purposes of this application, transmission will mean any device used between the prime mover and the pump to control the pump speed. Thus, the transmission could be manual or automatic shifted and could be multi gear ratio or variable speed, i.e. continuous. Thus a fixed ratio gear box that cannot be used to control the pump speed is not considered a transmission for purposes of this application.

The transmission allows the pump to pump at high rates and relatively low pressures when in "high" gears or at low rates and high pressures when in "low" gears. The horsepower is limited by the prime mover and the pump design. The typical transmissions have 5 or 6 possible gear ratios. The transmission used for a 500 hp multi-plunger pump cost about $30,000. In addition, the pump's lowest flow rate output is limited to the transmission gear ratio. Large volume pumps cannot reach the required low pump rates due to transmission ratio limits. Smaller pump and transmission arrangements that can reach the required low rates cannot meet the higher rates also required during well service work. Thus, two smaller pumps with accompanying engines and transmissions are typically required to meet the full range of rates and pressures needed in this type of work.

Thus, current multi-plunger well service pumps have two disadvantages. The first disadvantage concerns cost. Providing the pumps with transmissions and providing multiple pumps, engines and transmissions to achieve the required range of operating conditions is expensive, weighs more and takes up more space.

The second disadvantage of current multi-plunger well service pumps concerns performance. Pumps using current technology yield a discontinuous, stair step pressure-volume curve, have a limited working range, and are unable to be controlled by a computer.

The present invention addresses these problems by providing a single triplet pump that does not employ a transmission, but rather employs a means for varying the displacement of the pump to thereby provide the full range of operating conditions required for well service work. Thus, this system is less expensive since it eliminates the need for a transmission and eliminates the need for multiple pumps, engines, and transmissions. It furthermore can be computer controlled for improved performance while protecting driven components from excess input or over pressure.

The variable displacement pump's basic operation is similar to other reciprocating plunger pumps in that it employs a crankshaft with a connecting rod. The connecting rod is connected to a crosshead to which the pump plunger is attached. The big difference in the present invention over other reciprocating well service plunger pumps is that the amount of offset of the crank in the present invention is variable and that present pump does not employ a transmission as a means of varying the pumping rate of the pump.

U.S. Pat. No. 2,592,237 to E. H. Bradley recognized the desirability of using eccentric cams to obtain a stroke change for a plunger pump while the pump is operating. However, the means Bradley employed to change the relative positions of the cams was a rotating wheel that had to be grabbed by the operator while it was rotating and turned to change the stroke. In order for this to be done, the wheel had to be rotated at low speed, i.e. less than 60 rpm, so that the operator would be able to grab the turning wheel and rotate it in one direction or the other. If the operators action on the wheel served to slow down the rotation of the wheel, this would either increase or decrease the stroke. To have the opposite effect of the stroke, i.e. decrease or increase the stroke, the operator would have to turn the rotating wheel faster than the wheel was already rotating. This method of adjusting the stroke of the plunger employed by Bradley is crude, is inaccurate, is limited in the speed at which it can be accomplished, and is potentially dangerous to the operator. Also, it is a method that could not be automatically controlled by a computer. Further, the Bradley pump does not have means to adjust a pump with more than one plunger.

Other positive displacement pumps, such as the one taught in U.S. Pat. No. 4,830,589 to Ramon Pareja, teach variable stroke positive displacement pumps, but these require the pump to be stopped in order to change the stroke. The design allows for adjusting the stroke for more than one plunger but the design was not suitable to the high horsepower required for oil field service pumps.

Also, Dowell/Schlumberger originally designed PG oil well service multi-plunger pumps, which are typical of the type of pumps currently used in the oil field. The Serve model TPA-400 is typical of this type of pump. These pumps use cams for driving the connecting rods. However, the cams of these types of pumps are not variable and therefore can not be employed to vary the stroke of their associated plungers. The output is changed by varying the speed of the input drive shaft powering the pump.

Although diesel engines are employed to power most land based multi-plunger pumps, it is common to drive multi-plunger pumps with electric motors in offshore operations since most of the rigs are operated with electric motors rather than diesel engines. Variable motors and either DC or AC controls are required for operating conventional multi-plunger pumps at different speeds. These variable motors and controls are very expensive. The present invention would eliminate the need for these expensive variable speed electric motors and controls since it would require only fixed speed electric motors to power it. This would reduce the cost and the complexity for electrically powered installations over what is currently required.

A variable displacement reciprocating pump, such as the present invention, increases the range that a given pump can operate by being able to adjust the stroke of the pump as needed without varying the operation of the prime mover that powers the pump. Having a variable displacement pump eliminates the need for a multi-gear transmission. The pump input shaft of the present invention can be held at constant or near constant speed. Although variable displacement pumps have been employed in hydraulic transmissions for approximately 50 years, the mechanism used in hydraulic transmissions is not suitable for oil field service pump.

The present invention employs a method of adjusting the relative relationship between the outer and inner eccentric cams to vary the offset of the crank and thereby vary the stroke of the pump. The mechanism that adjusts the cams of the present invention is considered novel. The present invention has an intermediate drive shaft with gears that is parallel to the variable cam or central shaft. The parallel intermediate shaft is used to simultaneously power all of the outer eccentric cams. This system of driving the variable cam is novel. The inner eccentric cams normally rotate together with the outer eccentric cams with no relative motion. The power to the cams is split. The stroke of the pump is adjusted by rotating the inner cams relative to the outer cams. The relationship of the outer cam relative to the input drive shaft is fixed whereas the angular position of the inner cam is variable. The relative position of the inner cams relative to the outer cams is changed with a rotating hydraulic rotary actuator that is located between the input drive shaft and the inner cams. The inner and outer cams turn together with no relative rotation when the pump stroke is not being changed. The hydraulic rotary actuator is also turning while the pump is being operated. The hydraulic rotary actuator is connected to a control mechanism through a swivel union.

In addition, the relative position of the rotary actuator, and thus the stroke of the pump, is measured by an electronic position sensor provided on the present invention. A position signal is transmitted to a readout device or computer via a rotary slip ring. An input shaft speed sensor transmits the input speed to the computer. The computer can then calculate the pump output flow from pump speed and stroke. Alternately, a flow meter can be employed to measure the flow directly. A pressure transducer on the discharge of the pump measures pressure. The computer can calculate hydraulic horsepower from the measured pressure and flow. Thus, the computer can be set to control the pump output with several optional conditions. The computer can limit any one or combination of pump output pressure, output flow, and horsepower. Conventional pumps drive pumps through transmissions with discrete gear ratios and thus cannot be controlled proportionally with respect to flow output. The present invention is continuously variable and therefore can easily be controlled through a proportional controller. The controller controls the position of the rotary actuator and thus the pump stroke.

Use of a variable displacement pump makes a number of control options possible. The pump is continuously variable from 0 to 100% displacement. Thus by employing a feedback position sensor for displacement in combination with a speed sensor, pressure sensor, and a computer, the control system can limit any one or combination of pump output pressure, output flow and horsepower.

At this point it should be noted that there is a relationship between flow and pressure. During almost all pumping operations, the pressure on the pump will be related to the pumping rate plus a factor for the difference in the fluid density inside the casing verses outside the casing. Thus, if the pumping rate is reduced, the pressure will automatically be reduced, also.

The control system can have a pressure override feature similar to hydraulic systems that causes the pump to pump at lower rates if a preset pressure limit is reached. A pressure override would be automatic and cause the pump to destroke until the pressure limit was satisfied, even if it required the pump to destroke completely. Thus, the present invention would limit discharge pressure by destroking rather than through interaction with the typical engine and transmission of prior art pumps. Computer controlled rates would be easily accomplished without the step-wise changes that occur when employing transmissions with fixed gear ratios. Also, the continuous variability of the present pump allows it to operate at lower flow rates than conventional pump and transmission systems.

Also, a pumping horsepower limit can be set in the computer. The control system would calculate the actual pumping horsepower and when the limit is reached, the pump could be destroked to reduced the flow and therefore limit the horsepower. This will be useful to keep the engine or a pump from being overloaded. It also will be useful when the same engine is being used to drive other systems. If, for example, the engine has a potential of 650 hp, the power consumed by the present multi-plunger pump can be limited to 500 hp thus always leaving a minimum of 150 hp for other systems, i.e. for operating hydraulics to drive centrifugal pumps. In prior art systems, it was common to use a separate engine to operate other auxiliary systems such as centrifugal pumps. This was desirable since the auxiliary engine could be maintained at a constant speed, thus insuring predictable performance for the centrifugal pumps. The engine used to drive the prior art multi-plunger pump is typically operated at different speeds due to the need to adjust pumping speed. When pump speed was changed, typically engine speed and gear ratios were changed. If the same engine was used to drive both the triplex pump and an auxiliary pump, for example a centrifugal pump, the performance of the centrifugal pump would be adversely affected when transmission gear changes were made due to the accompanying engine speed changes. With the present invention, a single engine with more horsepower can be used simultaneously for both the multi-plunger and centrifugal pumps without sacrificing performance of the centrifugal pumps. At the same time the present multi-plunger pump is protected from being overloaded.

Thus the present variable displacement pump system has the advantage being lower in cost and performing better than prior art pumps. It does this by eliminating the need for multi-speed transmissions and thereby reducing the overall cost of the engine, transmission, and pump package. The cost of the present pump should be considerably less than that of a conventional pump and transmission which currently sells for about $95,000.00.

Also, the present invention reduces the need to have two pumps by being able to operate the multi-plunger at low displacement values, i.e. low flow rates, while being able to meet the highest pump rate needed.

Further the present invention limits the input to the pump gearbox to engine torque. This is contrasted with prior art engine and transmission pump systems which increased the engine torque by transmission gear reductions. Thus the input maximum torque on the present pump will be up to eight (8) times less than prior art pumps. Conventional systems require the changing of transmission ratio to reduce pump speed, to reduce discharge flow and to increase maximum possible pressure. The present pump achieves both by changing the pump stroke. Reducing the pump stroke on the present invention reduces the pump flow output and reduces the torque required to obtain a given discharge pressure.

In addition, using the present invention, two pumps can be driven with the same engine without a transmission while one or the other or both of the pumps can be stroked per the needs of the job. The pumps would be independently controlled so the pumps could be operated at different flow rates and different pressures, and could discharge to different parts of the well, for example, to the inside of the casing and to the annular part of the casing. The computer control could be set to limit the horsepower of each pump so that neither pump could be overpowered.

This arrangement could also be used to build a double pump cementer with only one engine. Typically, a double pump cementer has three engines where the third engine is used to drive auxiliary systems. The auxiliary systems can be any hydraulic, mechanical or electrical system that has a need for power. With the opportunity to operate the engine at a constant speed, then a single engine could be used to drive two variable displacement pumps and also the auxiliary systems. This arrangement would be more compact, have a lower weight, be simpler to control, and be more economical than currently available systems. Also, one engine having a horsepower equal to three separate engines is also more economical to purchase than the three separate engines in addition to the cost savings resulting from not needing a transmission associated with each engine plus extra controls and instruments for multiple engines, transmissions and pumps verses a single engine pump system.

And, the present invention is able to adjust the pump stroke for a multiple plunger pump simultaneously while the pump is turning and pumping. The present pump allows relatively high power transmission, i.e. greater than 500 hp, as is required for well service operations.

SUMMARY OF THE INVENTION

The present invention is a variable displacement reciprocating multi-plunger well service pump. The pump is attached on its power end to a prime mover that attaches to the pump at an input drive flange. An input drive shaft of the prime mover attaches to the pump input drive flange and subsequently to the pump input pinion shaft. The prime mover is a power source such as an engine or electric motor that powers the pump. Typically the power source is a diesel engine.

The pump is provided with an external power end case, a power end oil reservoir, a power end oil lube pump, and a pump fluid end where the pumping of fluid actually takes place. The mechanism for adjusting outer and inner eccentric cams in order to vary the offset or travel of the crank is located within the power end case.

The drive train or gears that drive the outer eccentric cams begin with the prime mover. The prime mover is provided with a rotatable input drive shaft. The input drive shaft is attached to and rotates the pump's input pinion shaft. The input pinion shaft is connected to a spiral bevel pinion gear. The spiral bevel pinion gear drives spiral bevel gear, which in turn drives lube pump shaft. Lube pump shaft drives additional gears and drives a power end lube pump. The additional gears that are driven by the lube pump shaft in turn drive other gears which in turn drive an intermediate drive shaft. The intermediate drive shaft drives one set of gears that in turn drive a second set of gears. This second set of gears is attached to common hubs with other gears that are turnable about the central shaft. These other gears attached to the common hub drive internal gears that are part of the outer cams, thus making the outer cams turn.

The drive train or gears that drive the inner eccentric cams also begin with the prime mover. The prime mover's input drive shaft is attached to the input pinion shaft which is connected to the spiral bevel pinion gear, and the pinion gear drives spiral bevel gear, as previously described. The spiral bevel gear is attached to a gear that drives another gear that has an integral hub shaft. The integral hub shaft is secured to the output shaft of a rotary actuator. The rotary actuator is provided with a mounting flange that is attached to a gear. This gear in turn drives another gear that is mounted on a central shaft by a spline. This central shaft has attached to it inner eccentric cams. The inner cams for a multi-plunger pump have their respective eccentric major axis located one hundred and twenty (120) degrees apart so that the multiple plungers will be out of phase with each other, thereby creating a more constant flow output for the pump fluid end. If the pump is not a multi-plunger pump the major axis locations for the multiple plungers will be appropriately spaced to achieve a more constant flow output from the pump. Thus, turning the common shaft turns all of the inner cams.

The turning outer cams along with the inner cams cause the crank end of the connecting rod to orbit about the crank. This orbiting action, typical of all reciprocating pumps, with the connection of an opposite end of the connecting rod to the crosshead via a wrist pin, drives the crosshead back and forth. The crosshead is connected to a pony rod that is connected to one of the pump plungers. The pump plungers enter the pump fluid end and function to pump fluid as is typical of other displacement reciprocating pumps.

The rotating center portion of the eccentric mechanism is the central shaft. The inner and outer eccentric cams normally revolve together with the central shaft with no relative motion occurring between the inner and outer eccentric cams. However, during the time that the stroke is being changed, there is relative motion between inner cams and outer cams. The inner cams are keyed to the central shaft so that it always rotates in conjunction with the central shaft. However the outer cams are not keyed to the central shaft and are capable of being rotated relative to the inner cams and the central shaft. Stated another way, the inner cams and the central shaft to which the inner cams are keyed are capable of being rotated relative to the outer cams. The outer surfaces of the outer cams turn inside connecting rod journal. The opposite end of the connecting rod pivots within bearing journal that is housed within the crosshead.

Each of the outer cams has a pair of driving gears. The driving gear pairs provide balanced and symmetrical driving forces for their associated outer cams. Both gears are able to turn about this central shaft with journal bearings in between the central shaft and the gears. The rotation of the gear about the central shaft causes the relative position of the inner and the outer cams to change, thus changing the length of the stroke or travel of the pump plunger resulting in a change of flow output for the pump fluid end.

A computer control system is provided for controlling the operation of the variable displacement reciprocating multi-plunger well service pump. The control system consist of a pressure sensor, speed sensor, actuator position sensor, manually operated 4-way hydraulic control valve, proportional 4-way electro-hydraulic valve, a computer, and an operator interface panel.

The pressure sensor may be an electronic pressure transducer typical of those used in the oil field today. It can measure pressure up to 15,000 psi and typically has an output signal of 4-20 milliamps. The speed sensor may be a proximity switch. It senses the presence of teeth on a wheel that is attached to the input drive shaft. Other types of speed sensors such as tachometer generators are acceptable. The output of the proximity switch is a frequency signal. The actuator position sensor may be a potentiometer. The manually operated 4-way hydraulic control valve has blocked cylinder ports and open pressure to tank ports while in the neutral or center position if a fixed volume pump is used, or alternately, cylinder ports blocked and pressure port blocked in neutral or center position when using a pressure compensated pump. The proportional 4-way electro-hydraulic valve is typical of valves manufactured by Parker Hannifin Corp., D1FX series. It is able to receive a proportional input signal from a computer and a feedback signal from the controlled component and send output hydraulic flow to the rotary actuator to control the rotary actuator's rotary position. The industrial control computer can be similar to those manufactured by Allen-Bradley, model SLC500 series.

This computer system has the ability to receive various frequency, milliamp and voltage signals and to have digital and proportional output signals. In the case of the pump control system, the computer processes the input signals, calculates pump flow and horsepower, and outputs a signal to the electro-hydraulic proportional valve to control the position of the pump hydraulic rotary actuator that controls the pump stroke. The operator interface panel communicates with the computer and displays process variables such as pump speed, pressure, pump stroke and calculated values of pump output flow and horsepower. The operator interface panel has a keypad that allows the operator to set any one or combination of desired flow, pressure and horsepower. The operator would be able to select what parameter he wants to control at various combinations of pressure, flow and or horsepower until set limit is reached. When the set point is reached, the control system would reduce the pump flow to limit the horsepower. In all probability, the pumping pressure will decline at the same time the flow is reduced. The actuator position sensor that senses the position of the hydraulic rotary actuator is a potentiometer that is attached to the outer housing for the rotary actuator and an input shaft of the sensor is attached to the actuator output shaft. Thus, the potentiometer, as the actuator position sensor, can sense the relative position of the rotary actuator. The output of the potentiometer will typically be a voltage. The sensor output is wired to a rotary slip ring that allows the electrical signal to be brought out of the rotating components. The hydraulic flow control from the hydraulic valves, either the manual valve or the proportional valve, is transmitted to the rotary actuator via a swivel union.

The pump will typically be driven by a diesel engine. The output of the diesel engine requires a power take off (PTO) with a clutch. The output of the PTO is attached to the input of the pump by input drive shaft. The pump would normally be in a neutral or zero stroke position when the PTO clutch is engaged. The turning of the input drive shaft thus causes the power end lube pump to turn and thus supply lubrication for the power end bearings and gears. The pump would normally be allowed to warm-up while the lube oil is circulated through the bearings and gears. At this point, all shafts, gears, and pump cranks are turning without stroking the plungers and all are being lubricated. The pump output flow for the pump fluid end is started by causing the inner cams to be turned relative to the outer cams. This is done by actuating either a manual or proportional hydraulic 4-way valve that directs oil pressure to one side of the rotating hydraulic rotary actuator. The resulting change in rotary actuator position causes the inner cams to rotate relative to the outer cams, thus changing the stroke of the pump. The multi-plunger fluid end flow rate is increased by further stroking the hydraulic rotary actuator.

Moving the rotary actuator causes the inner cams to rotate relative to the outer cams and thus causes the pump plungers to begin to stroke and to pump fluid. The movement of the crank and the subsequent stroke of the plungers remain constant when the outer and inner cams have no relative motion between them. In order to adjust the stroke and thereby adjust the fluid flow produced by the pump, the inner cams are rotated relative to the outer cams. This rotation of the inner cams relative to the outer cams is normally done while the pump is operating, i.e. rotating, by employing the rotary actuator.

An actuator position feedback sensor tells the operator the amount of the stroke. A computer can be attached to the position sensor and to an electro-hydraulic 4-way valve that can be used by a computer program to control the pump stroke. The computerized control system can be made to control the pump stroke according to one or more of the following parameters: set and control the output flow to a desired value, limit pump output pressure by destroking the pump once a preset limit has been reached, set a desired output pressure, and limit pump output horsepower.

Desired flow, pressure and horsepower can be set as well as limits for pressure and horsepower. For example, a desired flow can be set with pressure and horsepower limits also being set. The pump would then operate at the desired rate until either the pressure limit or the horsepower limit is reached, and once a limit is reached, the computer would subsequently cause the flow to reduce to thereby maintaining the pump within the desired limits.

Setting and controlling output flow to a desired value is done by interaction of a pump input shaft speed sensor, pump stroke position as indicated by the actuator position sensor and the computer. Once the operator has set the desired rate on the computer, the output from the speed sensor along with the speed of the input drive shaft is used to calculate output flow. Alternately, the actual flow produced at the pump fluid end of the pump can be measured with a flow meter. The computer controls the flow by sending an output signal to the electro-hydraulic valve that in turn directs oil to the rotary actuator. This changes the rotational position of the rotary actuator and in turn, adjusts the stroke of the pump plungers to obtain the desired rate.

In a different arrangement using the present invention, two pumps can be driven with the same engine without a transmission while one or the other or both of the pumps can be stroked independently per the needs of the job. With a splitter gear box, the power from a single engine can be split and supplied to two separate pumps via secondary input drive shafts. The pumps would be independently controlled so the pumps could be operated at different flow rates and different pressures, and could discharge to different parts of the well, for example, to the inside of the casing and to the annular part of the casing. The computer control could be set to limit the horsepower of each pump so that neither pump could be overpowered.

This single engine and double pump arrangement could also be used to build a double pump cementer where the single engine would drive auxiliary systems in addition to the two variable displacement pumps. With the opportunity to operate the engine at a constant speed, then a single engine could be used to drive two variable displacement pumps and also the auxiliary systems. Such as single engine and double pump arrangement would not require a transmission and would not require the extra engines and associated controls and instrumentation needed for multiple engine arrangements.

DETAILED DESCRIPTION OF THE PREFERRED EMBODIMENT

The Invention

Figure 1:
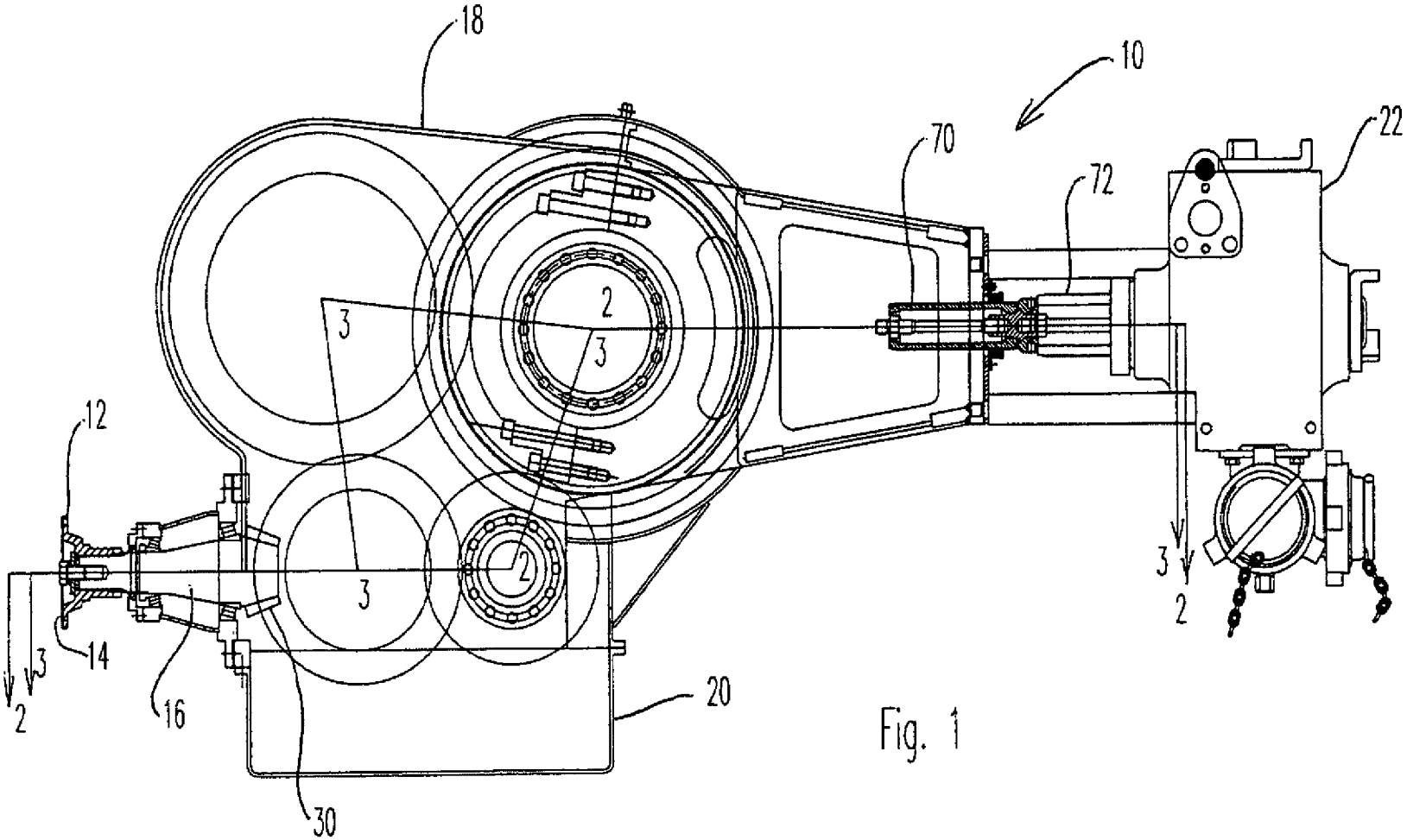
FIG. 1 is a side view of a variable displacement reciprocating multi-plunger well service pump constructed in accordance with a preferred embodiment of the present invention.
Figure 8:
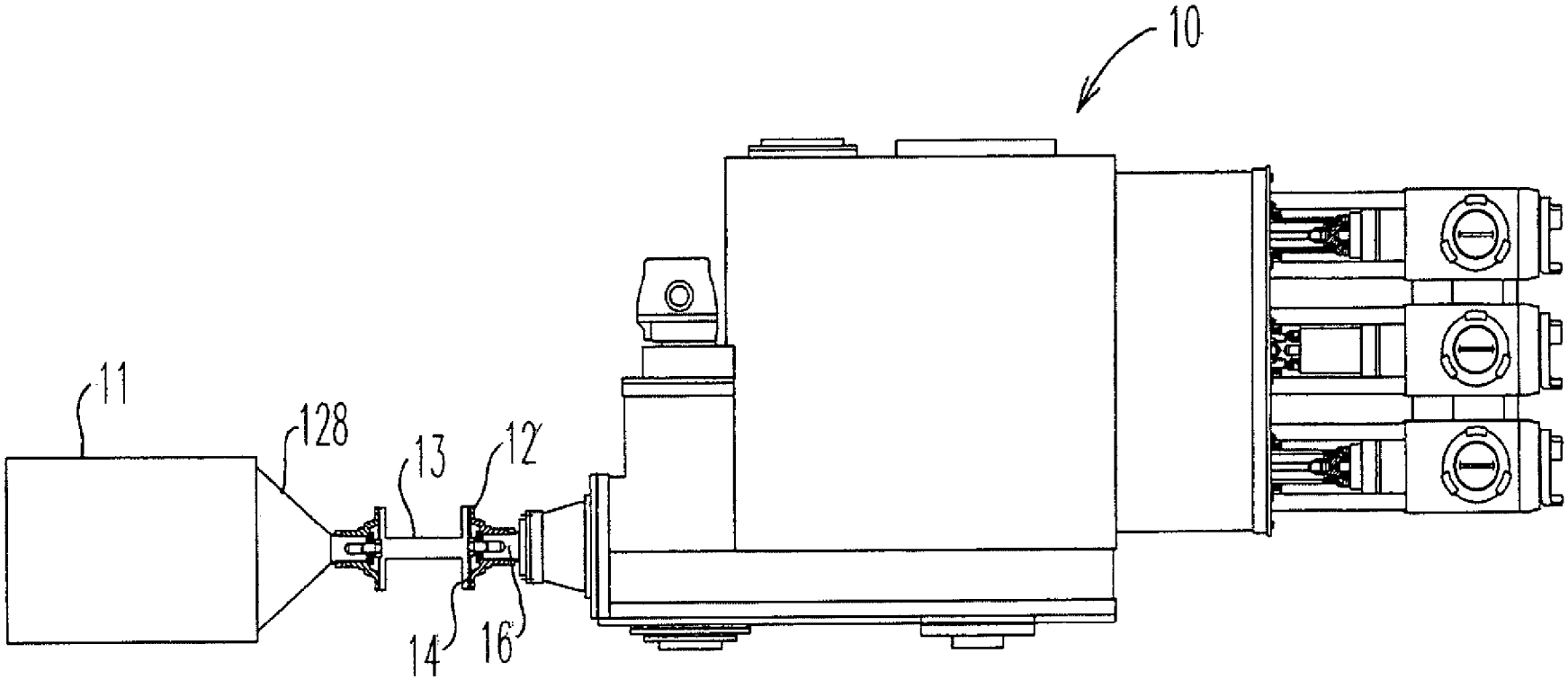
FIG. 8 is a schematic showing a single prime mover attached to and powering a single variable displacement reciprocating multi-plunger well service pump.

Referring now to the drawings and initially to FIGS. 1 and 8, there is illustrated a variable displacement reciprocating multi-plunger well service pump 10 constructed in accordance with a preferred embodiment of the present invention. As shown in FIG. 8, the pump 10 is attached on its power end input 12 to a power source or prime mover 11, such as an engine or electric motor. Typically, the prime mover 11 is a diesel engine and the output of the diesel engine requires a power take off (PTO) with a clutch 128 or a torque converter. The clutch 128 is attached to the input of the pump 10 by rotatable input drive shaft 13 and by input drive flange 14. Input drive flange 14 is attached to and turns input pinion shaft 16. The pump prime mover 11 powers the pump 10.

As shown in FIG. 1, the pump 10 is provided with an external power end case 18, a power end oil reservoir 20, and a pump fluid end 22 where the pumping of fluid actually takes place. As will be more fully described hereafter, the mechanism for adjusting outer and inner eccentric cams 24 and 26 in order to vary the offset or travel of the crank 28 is located within the power end case 18.

Figure 2:
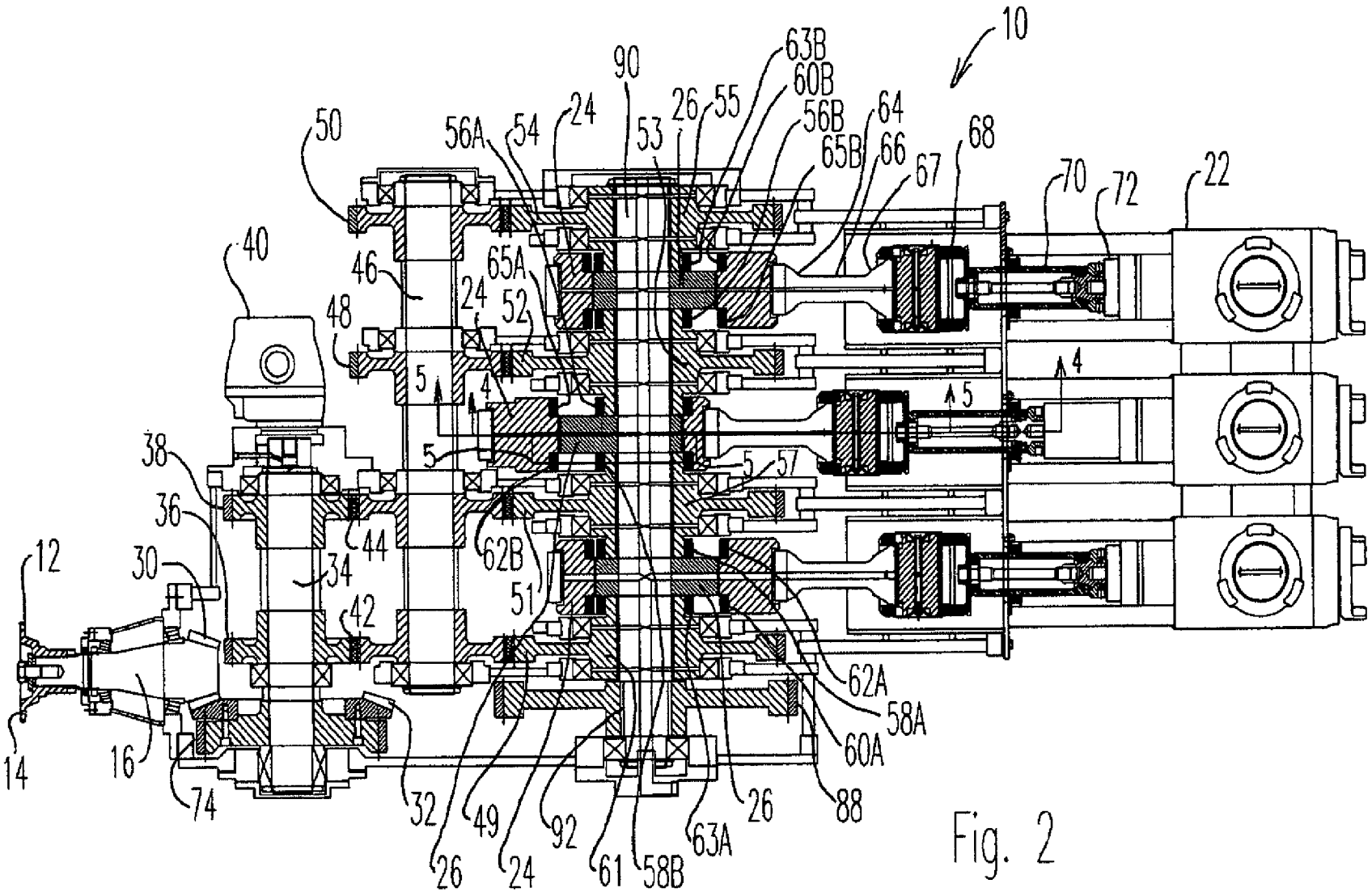
FIG. 2 is a cross sectional view taken along line 2-2 of FIG. 1.

Referring now to FIG. 2, the drive train or gears that drive the outer cams 24 are illustrated. Discussion about these gears will begin with the prime mover 11, shown in FIG. 8. The prime mover 11 has a rotatable input drive shaft 13 that attaches to and drives input drive flange 14. The input drive flange 14 is attached to and serves to rotate input pinion shaft 16. The input pinion shaft 16 is connected to spiral bevel pinion gear 30. The pinion gear 30 drives spiral bevel gear 32, which in turn drives lube pump shaft 34. Lube pump shaft 34 drives gears 36 and 38 and power end lube pump 40. Gears 36 and 38 drive gears 42 and 44 which in turn drive intermediate drive shaft 46 and gears 48 and 50 that are attached to the intermediate drive shaft. Thus gears 42, 44, 48 and 50 all turn in conjunction with the intermediate drive shaft 46. Gears 42, 44, 48 and 50 drive, respectively, gears 49, 51, 52, and 54. Gear 49 is attached to common hub 61 with gear 63A. Gear 51 is attached to a common hub 57 with gears 58A and 58B. Gear 52 is attached to a common hub 53 with gears 56A and 56B. Gear 54 is attached to a common hub 55 with gear 63B. Gears 63A and 58A together will power one plunger 72; gears 58B and 56A will power another plunger 72; and gears 56B and 63B will power the final plunger 72 of the multi-plunger pump 10.

Thus when gears 42, 44, 48 and 50 turn, their associated common hubs 61, 57, 53, and 55 cause gears 63A, 58A, 58B, 56A, 56B, and 63B to also turn. These gears 63A, 58A, 58B, 56A, 56B, and 63B respectively, drive internal gears 60A, 62A, 62B, 65A, 65B, 60B that are part of outer cams 24, thus causing the outer cams 24 to turn. Drive internal gears 60A and 62A are part of one outer cam 24, drive internal gears 62B and 65A are part of another outer cam 24, and drive internal gears 65B and 60B are part of the final outer cam 24.

Figure 5:
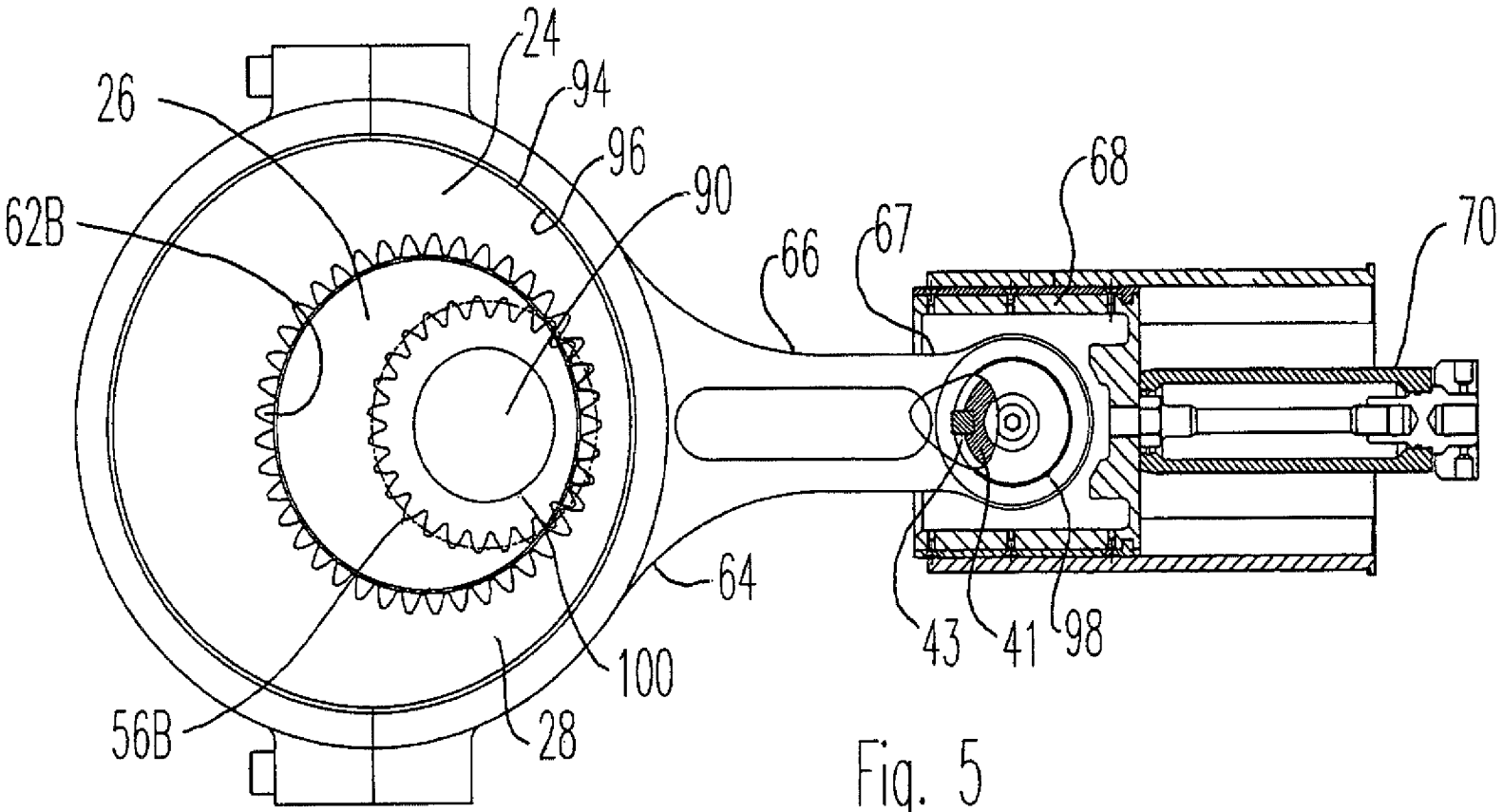
FIG. 5 is a cross sectional view taken along line 5-5 of FIG. 2.

The turning outer cams 24 cause the crank ends 64 of the connecting rods 66 to orbit about the cranks 28. This orbiting action, typical of all reciprocating pumps, with the connection of an opposite crosshead end 67 of the connecting rod 66 to the crosshead 68 via a wrist pin 41 to which it attaches via a key 43, drives the crosshead 68 back and forth, as illustrated in FIG. 5. The crosshead 68 is connected to a pony rod 70 that is connected to pump plunger 72. Plunger 72 enters the pump fluid end 22 and functions to pump fluid as is typical of other displacement reciprocating pumps.

Figure 3:
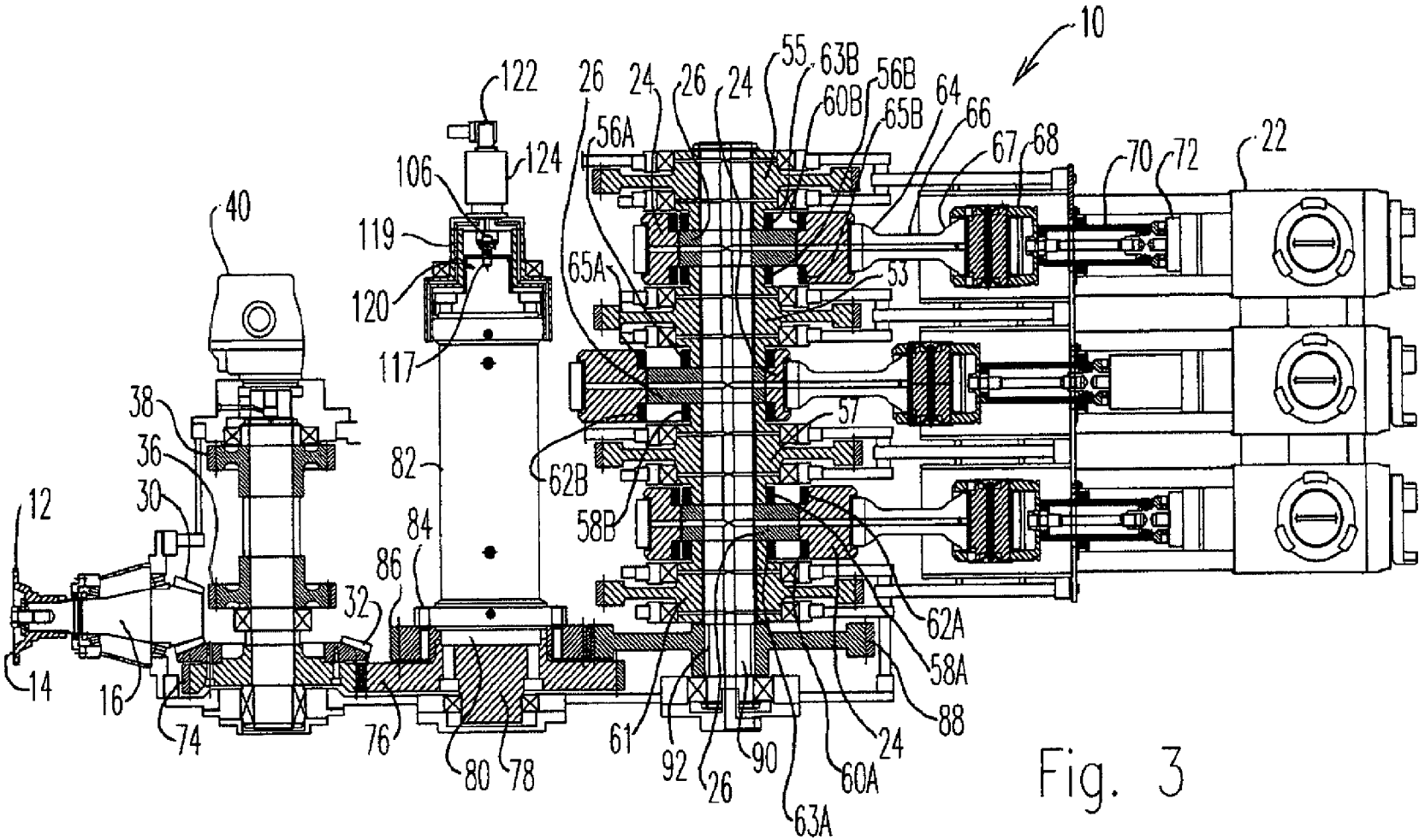
FIG. 3 is a cross sectional view taken along line 3-3 of FIG. 1.

Referring now to FIG. 3, the drive train or gears that drive the inner cams 26 are illustrated. Discussion about these gears will likewise begin with the prime mover 11, shown in FIG. 8. The prime mover 11 is provided with rotatable input drive shaft 13 that is attached to and serves to rotate input pinion shaft 16 via input drive flange 14. As previously described in association with FIG. 2, the input pinion shaft 16 is connected to the spiral bevel pinion gear 30, and the pinion gear 30 drives spiral bevel gear 32. Spiral bevel gear 32 is attached to gear 74. Gear 74 drives gear 76 that has an integral hub shaft 78. The integral hub shaft 78 is secured to the output shaft 80 of rotary actuator 82. The rotary actuator 82 is provided with a mounting flange 84 that is attached to gear 86. Gear 86 in turn drives gear 88 that is mounted on central shaft 90 by a spline 92. Central shaft 90 has inner eccentric cams 26 secured to it so that the inner eccentric cams 26 turn in conjunction with the central shaft 90.

The cams 26, for a multi-plunger pump 10, have their respective eccentric major axis located one hundred twenty (120) degrees apart so that the multiple plungers 72 will be out of phase with each other, thereby creating a more constant flow output for the pump fluid end 22. If the pump 10 is not a multi-plunger pump having three plungers, then the major axis locations for the multiple plungers 72 will be appropriately spaced to achieve a more constant flow output from the pump 10. For example, for a quintaplex pump, the major axis spacing would be approximately seventy two (72) degrees apart.

Figure 4:
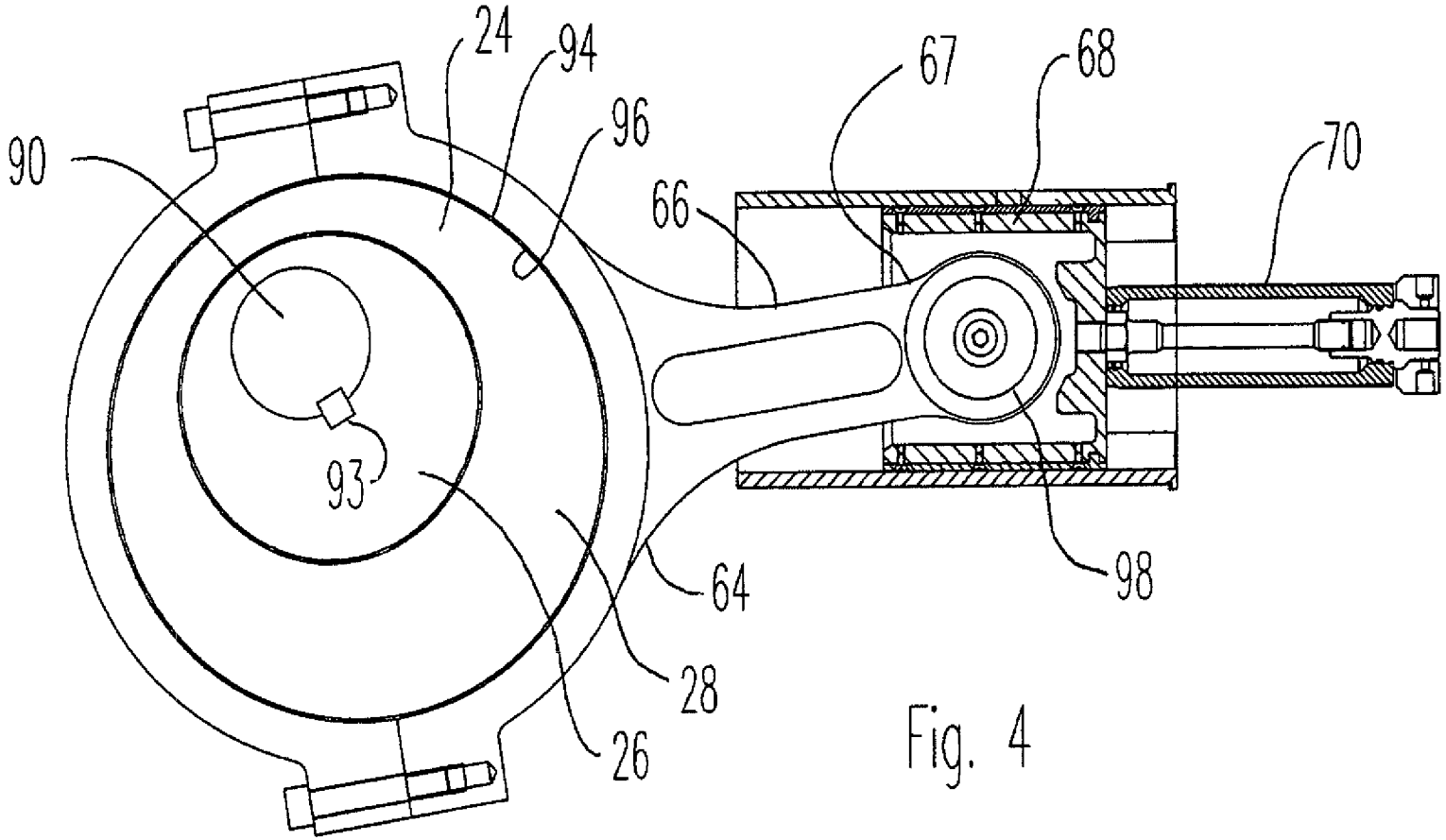
FIG. 4 is a cross sectional view taken along line 4-4 of FIG. 2.

FIG. 4 shows the relationship of the outer and inner eccentric cams 24 and 26, the connecting rod 66 and crosshead 68. This illustration shows the middle plunger stroking mechanism depicted in FIG. 2. It shows the inner cams 26, the outer cams 24, the connecting rod 66, the crosshead 68, and the pony rod 70. The rotating center portion of the eccentric mechanism is central shaft 90. The inner and outer eccentric cams 26 and 24 normally revolve together with the central shaft 90 with no relative motion occurring between the inner and outer eccentric cams 26 and 24. However, during the time that the stroke is being changed, there is relative motion between inner cams 26 and outer cams 24. The inner cams 26 are keyed to the central shaft 90, as shown by the key 93 in FIG. 4, so that the inner cams 26 always rotate in conjunction with the central shaft 90. However the outer cams 24 are not keyed to the central shaft 90 and are capable of being rotated relative to the inner cams 26, or stated another way, the central shaft 90 and the attached inner cams 26 are capable of being rotated relative to the outer cams 24 The outer surfaces 94 of the outer cams 24 turn inside their connecting rod journals 96. The opposite ends 67 of the connecting rods 66 pivot within bearing journals 98 that are each housed within their associated crosshead 68.

FIG. 5 is a view similar to FIG. 4 in that it is taken through the middle plunger stroking mechanism of FIG. 2 but is slightly offset to view the driving mechanism for the outer cams 24. FIG. 5 shows driving gear 58B provided on the inner cam 26 and driven gear 62B provided on the outer cam 24. Actually each outer cam 24 has a pair of driving gears which are best viewed in either FIG. 2 or FIG. 3. One pair of these driving gears is comprised of gears 63A and 58A; another pair is comprised of gears 58B and 56A; and the final pair is comprised of gears 56B and 63B. The driving gear pairs (63A and 58A), (58B and 56A) and (56B and 63B) provide balanced and symmetrical driving forces for the outer cams 24. Referring again to FIG. 5, gear 58B is able to turn about central shaft 90 with journal bearings 100 in between the central shaft 90 and the gear 58B. The rotation of gear 58B about central shaft 90 engages gear 62B and causes the relative position of the inner and the outer cams 26 and 24 to change, thus changing the length of the stroke or travel of the pump plunger 72 resulting in a change of flow output for the pump fluid end 22.

Figures 6, 10:
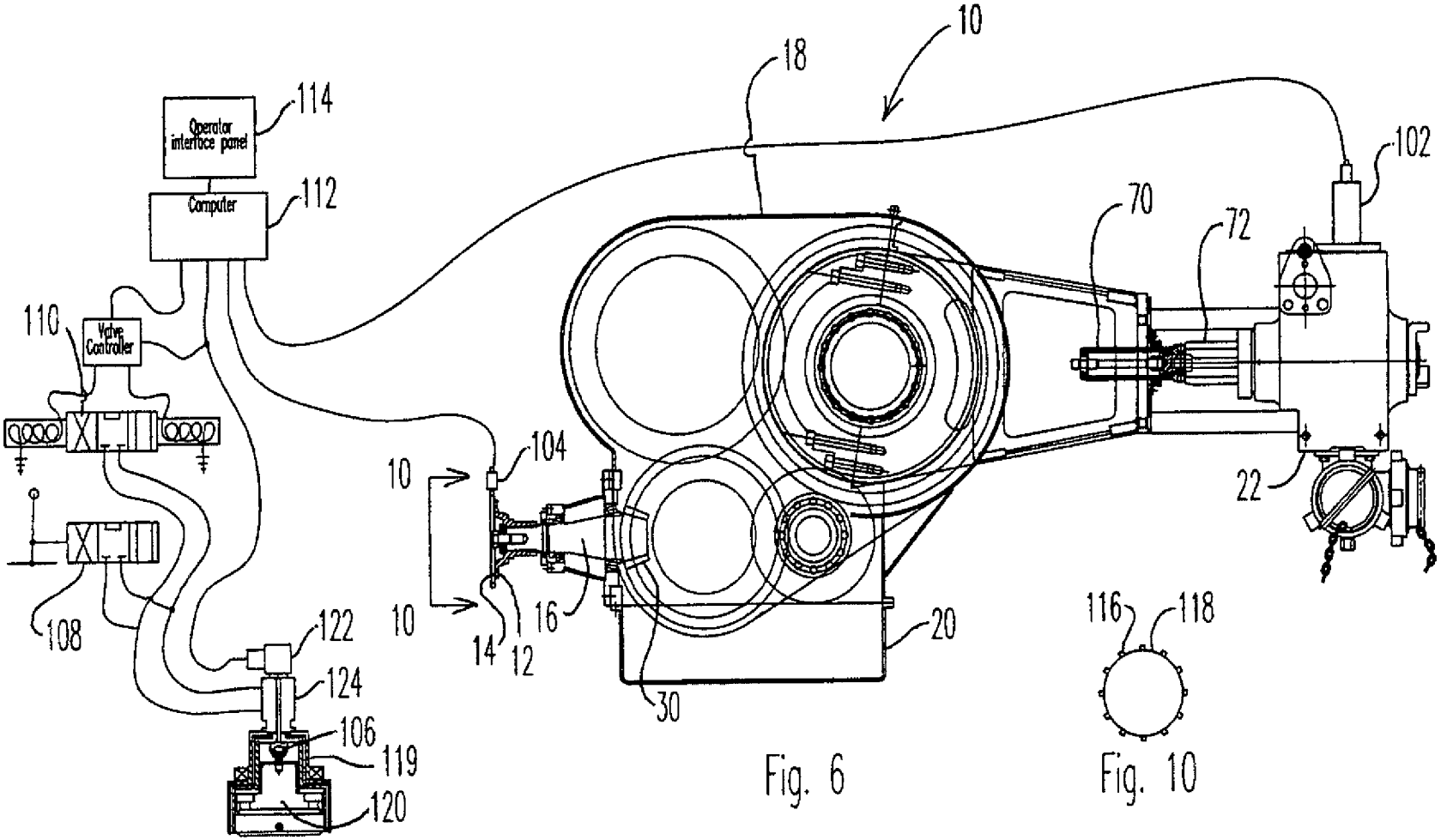
FIG. 6 is a schematic drawing of the control system for the variable displacement reciprocating multi-plunger well service pump of FIG. 1.
FIG. 10 is an end view taken along line 10-10 of FIG. 6 showing the teeth on a wheel that is attached to the input drive shaft to allow a proximity switch speed sensor to sense the speed of the input drive shaft.

FIG. 6 is a schematic drawing of a computer control system for the variable displacement reciprocating multi-plunger well service pump 10. The control system consist of a pressure sensor 102 attached to the discharge of the pump 10 at the pump fluid end 22 and monitoring the pressure of the fluid output, speed sensor 104 attached to the input drive shaft 13 and monitoring the speed of the input drive shaft 13, actuator position sensor 106 attached to the rotary actuator 82 and monitoring the rotary actuators position, manually operated 4-way hydraulic control valve 108 operatively attached to the rotary actuator 82 for manually rotating the rotary actuator 82, proportional 4-way electro-hydraulic valve 110 operatively attached to the rotary actuator 82 for computer-controlled rotation of the rotary actuator 82, a computer 112, and operator interface panel 114. Both the manually operated 4-way hydraulic control valve 108 and the proportional 4-way electro-hydraulic valve 110 are stationary relative to the rotating rotary actuator 82. Although not illustrated, both the manually operated 4-way hydraulic control valve 108 and the proportional 4-way electro-hydraulic valve 110 is attached to and powered by a hydraulic power source, either fixed volume pump or pressure compensated pump. Such power supply details are known to those skilled in hydraulic system design.

The pressure sensor 102 illustrated is an electronic pressure transducer typical of those used in the oil field today. It can measure pressure up to 15,000 psi and has an output signal of 4-20 milliamps. The speed sensor 104 illustrated is a proximity switch. Referring also to FIG. 10, the speed sensor 104 senses the presence of teeth 116 on a wheel 118 that is attached to the input drive shaft 13. Other types of speed sensors such as tachometer generators are acceptable. The output of the proximity switch is a frequency signal. The actuator position sensor 106 is a potentiometer and has an output in volts. The manually operated 4-way hydraulic control valve 108 has blocked cylinder ports and open pressure to tank ports while in the center position when using a fixed displacement hydraulic pump or cylinder ports blocked and pressure blocked when a pressure compensated pump is used. The proportional 4-way electro-hydraulic valve 110 is typical of valves manufactured by Parker Hannifin Corp., D1FX series. It is able to receive a proportional input signal from a computer 112 and a feedback signal from the rotary actuator position sensor 106 and send output hydraulic flow to the hydraulic cylinder of the rotary actuator 82 to control that cylinder's position. The industrial control computer 112 can be similar to those manufactured by Allen-Bradley, model SLC500 series.

This computer system has the ability to receive various frequency, milliamp and voltage signals, convert these inputs into digital signals, make calculations using the digital signals, make logic decisions based on the digital signals and calculations, and provide digital and proportional output signals to control the operation of the pump 10 based on the logic decisions. In the case of the pump control system, the computer 112 processes the input signals, calculates pump flow and horsepower, and outputs a signal to the electro-hydraulic proportional valve 110 to control the position of the pump hydraulic rotary actuator 82 that controls the pump stroke. The operator interface panel 114 communicates with the computer 112 and displays process variables such as pump speed, pressure, pump stroke and calculated values of pump output flow and horsepower. The operator interface panel 114 has a keypad that allows the operator to set one or any combination of desired flow, pressure and horsepower and place limits on either or both pressure and horsepower. The operator would be able to select what parameter he wants to control at various combinations of pressure and flow until the pressure or horsepower set limit is reached. When the set point is reached, the control system would reduce the pump flow to limit the pressure or horsepower. In all probability, the pumping pressure will decline at the same time the flow is reduced. The actuator position sensor 106 that senses the position of the hydraulic rotary actuator 82 is a potentiometer that is attached to the outer housing 119 for the rotary actuator 82 and an input shaft 117 of the sensor 106 is attached to the actuator output shaft 120. Thus, the potentiometer, as the actuator position sensor 106, can sense the relative position of the rotary actuator 82. The output of the potentiometer will be a voltage. The sensor output is wired to a rotary slip ring 122 that allows the electrical signal to be brought out of the rotating components. The hydraulic flow control from the hydraulic valves, either the manual valve 108 or the proportional valve 110, is transmitted to the rotary actuator 82 via a swivel union 124.

Figure 9:
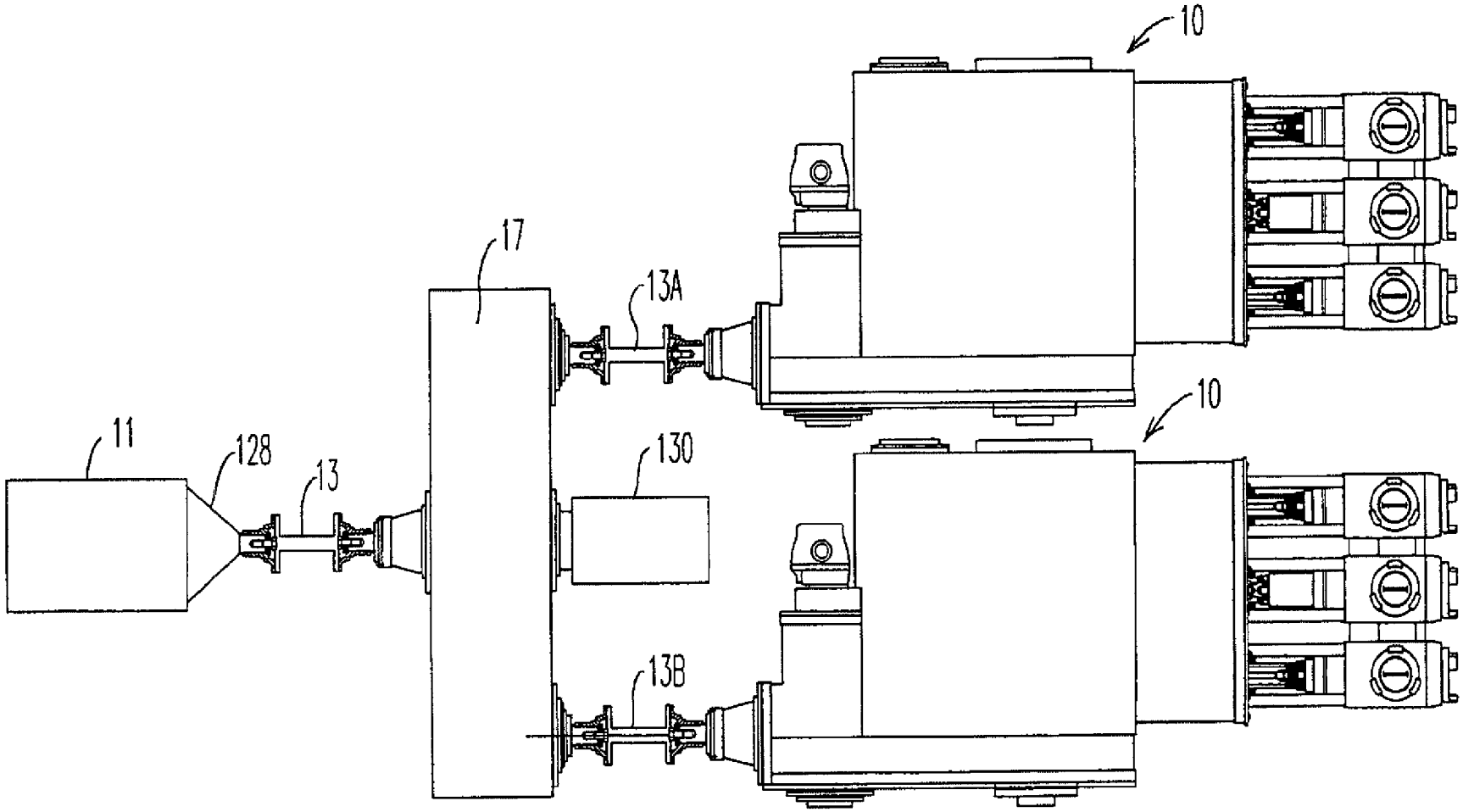
FIG. 9 is a schematic showing a single prime mover attached to and powering two variable displacement reciprocating multi-plunger well service pumps.

Referring to FIG. 9, a different arrangement using the present invention is illustrated. This is a single engine 11 and double pump 10 arrangement. In this arrangement, two pumps 10 can be driven by the same engine 11 without a transmission while one or the other or both of the pumps 10 can be stroked independently per the needs of the job. With a splitter gearbox 17, the power from a single engine 11 can be split and supplied to two separate pumps 10 via secondary input drive shafts 13A and 13B that originate in the splitter gear box 17. The pumps 10 would be independently controlled so the pumps 10 could be operated at different flow rates and different pressures, and could discharge to different parts of the well, for example, to the inside of the casing and to the annular part of the casing. The computer control could be set to limit the horsepower of each pump 10 so that neither pump 10 could be overpowered.

As shown in outline in FIG. 9, the single engine and double pump arrangement could also be used to build a double pump cementer where the single engine 11 would drive one or more auxiliary systems 130 in addition to the two variable displacement pumps 10. With the opportunity to operate the engine 11 at a constant speed, then a single engine 11 could be used to drive the two variable displacement pumps 10 and also the auxiliary systems 130. Such as single engine and double pump arrangement would not require a transmission and would not require extra engines and associated controls and instrumentation needed for multiple engine and pump arrangements.

Operation of the Invention

Figure 7A:
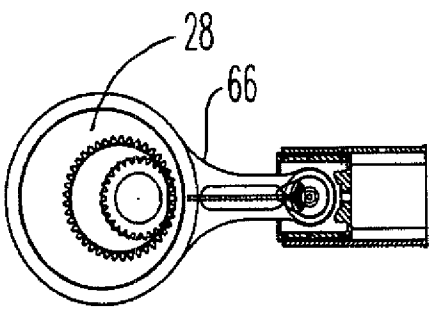
FIGS. 7A-7H illustrate the different positions of a crank when the pump is operating at maximum offset or stroke.
Figure 7B:
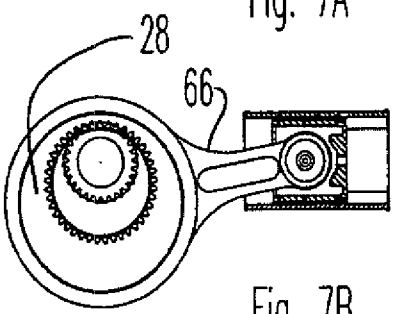
Figure 7C:
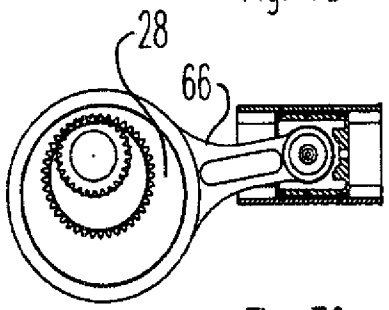
Figure 7D:
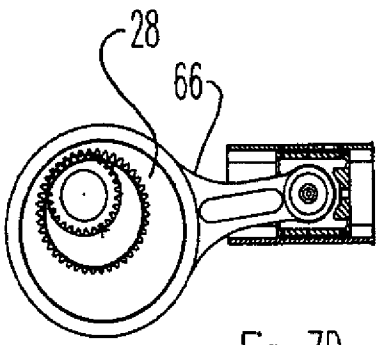
Figure 7E:
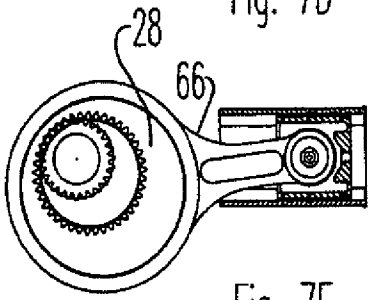
Figure 7F:
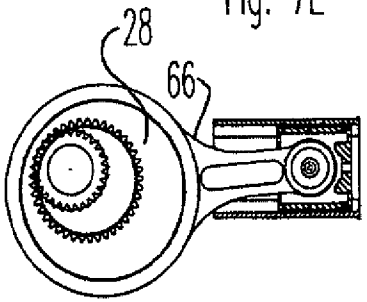
Figure 7G:
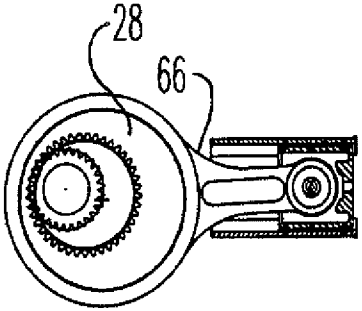
Figure 7H:
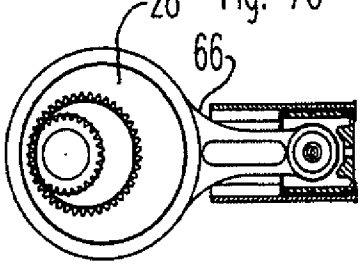
Figure 7J:
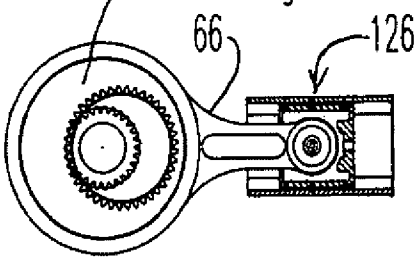
FIG. 7J illustrates the crank position when the pump is operating at zero stroke which produces no flow.

The pump 10 will typically be driven by a diesel engine prime mover 11. The output of the diesel engine prime mover 11 requires a power take off (PTO) with a clutch 128 or a torque converter. The output of the PTO is attached to the input of the pump 10 by input drive shaft 13 and input pinion shaft 16. The pump 10 would normally be in a neutral or zero stroke position 126, as illustrated in FIG. 7J, when the PTO clutch is engaged. The turning of the input drive shaft 13 thus causes the power end lube pump 40 to turn and supply pump oil from the power end oil reservoir 20 and to supply pressure lubrication to the pump's bearings and gears. The pump 10 would normally be allowed to warm-up while the lube oil is circulated through the bearings and gears. The pump output flow for the pump fluid end 22 is started by causing the inner cams 26 to be turned relative to the outer cams 24. This is done by actuating a hydraulic 4-way valve 108 or 110 that directs oil pressure to one side of the rotating hydraulic rotary actuator 82. The rotary actuator 82 is connected to the inner cams 26 and internal movement of the rotary actuator 82 results in movement of the inner cams 26 relative to the outer cams 24. This internal movement of the rotary actuator 82 that is caused by the hydraulic 4-way valve 108 or 110 should be distinguished from the normal rotation of the rotary actuator 82 during operation of the prime mover 11. The triplex flow rate is increased by further stroking the hydraulic rotary actuator 82.

Once the rotary actuator 82 is moved, this causes the inner cams 26 to rotate relative to the outer cams 24 and thus causes the plunger 72 to begin to stroke and to pump fluid. Typical movement of the crank 28 at maximum stroke of the plunger 72 is shown in FIGS. 7A through 7H. The movement shown in FIGS. 7A through 7H is produced where the outer and inner cams 24 and 26 have no relative motion between them. In order to adjust the stroke and thereby adjust the fluid flow produced by the pump 10, the inner cams 26 are rotated relative to their associate outer cams 24. This rotation of the inner cams 26 relative to the outer cams 24 is done while the pump 10 is operating, i.e. pumping.

An actuator position feedback sensor 106 tells the operator the amount of the stroke. A computer 112 can be attached to the position sensor 106 and to an electro-hydraulic 4-way valve that can be used by a computer program to control the pump stroke. The computerized control system can be made to control the pump stroke according to one or more of the following parameters: set and control the output flow to a desired value, set a desired output pressure, limit pump output pressure by destroking the pump 10 once a preset limit has been reached, and limit pump output horsepower.

To set and control output flow to a desired value, this is done by interaction of a pump input shaft speed sensor 104, pump stroke position as indicated by the actuator position sensor 106 and the computer 112. Once the operator has set the desired rate on the computer 112, the output from the speed sensor 104 and the actuator position feedback sensor 106 are used to calculate output flow. Alternately, an actual measured flow produced at the pump fluid end 22 of the pump 10 can be used. The actual flow can be measured by using a flow meter. The computer 112 controls the flow by sending an output signal to the hydraulic valve 110 that in turn directs oil to the rotary actuator 82. This changes the rotational position of the rotary actuator 82 and in turn, adjusts the stroke of the pump plungers 72 to obtain the desired rate.

Although the invention has been described as having the stroke adjusting mechanism, i.e. the rotary actuator 82, installed in the gear train or power train for the inner cams 26, the invention is not so limited and the stroke adjusting mechanism could just as easily be installed in the gear train or power train for the outer cams 24. The important thing is that the stroke adjusting mechanism be installed so that it acts on either the inner cams 26 or the outer cams 24 to thereby change the relative position of the cams 26 and 24.

Also, although the invention has been described and illustrated as employing a hydraulic rotary actuator 82, the invention is not so limited. Instead of using a hydraulic rotary actuator 82, a high torque electric motor could be employed in the invention as the actuator and serve the same purposes as described above in relationship to the hydraulic rotary actuator 82.

Finally, although not illustrated, a pressure override system that limits pump output pressure could be done hydraulically without use of electronics or a computer 112. This could be done by adding an adjustable pressure responding valve onto the pump fluid end 22. This pressure responding valve would produce an output pressure when a preset pressure is reached in the pump fluid end 22. The output pressure from this adjustable pressure responding valve could then, in turn, operate another 4-way valve that would be similar to the manual operated 4-way valve 108. Operating this additional 4-way valve would cause the rotary actuator 82 to reduce the stroke of the pump 10 and thus limit the pump's output pressure.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A variable displacement reciprocating pump comprising:

a prime mover;

an intermediate shaft directly or indirectly driven by said prime mover;

a rotating rotary actuator directly or indirectly driven by said prime mover;

a central shaft;

at least one outer eccentric cam carried by said central shaft;

at least one inner eccentric cam carried by said central shaft;

wherein either said outer eccentric cam or said inner eccentric cam is fixed to said central shaft and wherein at least one central shaft gear is associated with the non-fixed eccentric cam;

at least one intermediate shaft gear carried by said intermediate shaft, said intermediate shaft gear engaging said central shaft gear thereby providing a drivable connection between said prime mover and said central shaft;

a crank end coupled to said outer cam;

a plunger connected to said crank end by a connecting rod wherein said rotating rotary actuator directly or indirectly engages said central shaft thereby providing a drivable connection between said prime mover and said central shaft and wherein adjustment of said rotating rotary actuator provides for adjustment of said fixed eccentric cam relative to said non-fixed eccentric cam thereby adjusting the stroke of said plunger and the displacement of said pump.

2. A variable displacement reciprocating pump according to claim 1 wherein:

said variable displacement reciprocating pump has at least three inner eccentric cams;

each inner eccentric cam has 120 degrees of separation with respect to its major axis and the major axis of both other inner eccentric cams; and each inner eccentric cam is disposed within an outer eccentric cam, each said outer eccentric cam driving a plunger of said pump.

3. A variable displacement reciprocating pump system according to claim 1 where said prime mover is drivably connected to a plurality of variable displacement reciprocating pumps and the rotary actuator of each said variable displacement reciprocating pump is independently controlled.

4. The variable displacement reciprocating pump of claim 1, further comprising a lube pump, said lube pump driven by said prime mover and wherein said lube pump drives both said intermediate shaft and said rotating rotary actuator.

5. The variable displacement reciprocating pump of claim 1, wherein said rotating rotary actuator is hydraulically actuated.

6. The variable displacement reciprocating pump of claim 1, wherein said rotating rotary actuator is electrically actuated.

7. The variable displacement reciprocating pump of claim 1, wherein adjustment of said rotating rotary actuator may occur during operation of said pump.

8. The variable displacement reciprocating pump of claim 1, wherein the stroke of said plunger may be adjusted from 0% to 100% displacement by adjusting the relative position of the fixed eccentric cam to the non-fixed eccentric cam through movement of the rotating rotary actuator.

9. The variable displacement reciprocating pump of claim 1, wherein two central shaft gears are associated with the non-fixed eccentric cam, said gears connected to opposing lateral sides of said non-fixed eccentric cam.

10. The variable displacement reciprocating pump of claim 5, wherein said rotating rotary actuator is configured to rotate at a constant velocity during constant volumetric pump operation and configured to temporarily rotate at a different speed in response to hydraulic input.

11. The variable displacement reciprocating pump of claim 6, wherein said rotating rotary actuator is configured to rotate at a constant velocity during constant volumetric pump operation and configured to temporarily rotate at a different speed in response to electrical input.

* * * * *